US006428056B1

(12) United States Patent
Issagholian-Havai

(10) Patent No.: US 6,428,056 B1
(45) Date of Patent: Aug. 6, 2002

(54) METHOD AND APPARATUS FOR STACKING ANKLE PLATES TO PERMIT FREE, SLIDING, LATERAL DISPLACEMENT OF PLATES

(76) Inventor: Robert Issagholian-Havai, 5119 Azusa Canyon Rd., Baldwin Park, CA (US) 91706

( * ) Notice: Subject to any disclaimer, the term of this patent is extended or adjusted under 35 U.S.C. 154(b) by 0 days.

(21) Appl. No.: 09/572,704

(22) Filed: May 16, 2000

(51) Int. Cl.[7] ..... F16L 23/00; F16B 15/08

(52) U.S. Cl. ..... 285/405; 285/182; 285/424; 411/442

(58) Field of Search ..... 285/182, 405, 285/424; 411/442

(56) References Cited

U.S. PATENT DOCUMENTS

| | | | | | |
|---|---|---|---|---|---|
| 4,244,609 | A | * | 1/1981 | Smitka | 285/405 |
| 5,005,879 | A | * | 4/1991 | Jackson | 285/405 |
| 5,283,944 | A | | 2/1994 | Goodhue | |
| 5,342,100 | A | | 8/1994 | Goodhue | |
| 5,564,758 | A | * | 10/1996 | Tiberio | 285/405 |

* cited by examiner

*Primary Examiner*—Neill Wilson
(74) *Attorney, Agent, or Firm*—Tod R. Nissle, P.C.

(57) ABSTRACT

A method and apparatus shapes and dimensions the flanges of angle plates to ensure that the plates can be stacked without nesting.

10 Claims, 5 Drawing Sheets

METHOD AND APPARATUS FOR STACKING ANKLE PLATES TO PERMIT FREE, SLIDING, LATERAL DISPLACEMENT OF PLATES

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

This invention relates to angle plates.

More particularly, the invention relates to angle plates which are mounted on channel flanges that are at the end of a sheet metal duct. The angle plates are mounted at the corners of the duct. Each angle plate on the end of one duct is placed in registration with and bolted to an angle plate on the end of an adjacent duct. This bolting operation connects the angle plate—channel flange structure at the end of one duct to the angle-plate—channel flange structure at the adjacent end of another duct to secure the two duct ends together. See, for example, U.S. Pat. No. 5,342,100 to Goodhue.

2. Description of the Related Art Including Information Disclosed Under 37 C.F.R. 1.97 and 1.98.

As is explained in U.S. Pat. No. 5,342,100 to Goodhue, during installation of angle plates in channel flanges, it is desirable to stack a plurality of angle plates in registration with each other and to laterally slide and displace one angle plate at a time out from the stack, much like the top and bottom card in a deck of cards can be laterally slid and displaced from the deck when the other cards are held. When each of the conventional angle plates 10, 11, 12 in a stack tend to nest in the manner illustrated in FIG. 1, this interferes with the lateral displacement and sliding of an angle plate from a stack of angle plates. Specifically, as shown in FIG. 1, conventional angle plates include upstanding feet or flanges 13, 14, 15 which each depend and extend outwardly from a peripheral side area of legs and corners that comprise in part each angle plate. These flanges 13, 14, 15 permit the partial nesting of angle flanges one in the other. One way to prevent the nesting permitted by upstanding flanges 13, 14, 15 is disclosed in the Goodhue patent and comprises utilizing projections 46, 47 (FIGS. 3, 20, 21 of Goodhue) which depend upwardly from the legs and corner of each angle plate.

One disadvantage of the structure set forth in the Goodhue patent is that it requires, in the inner areas of an angle plate, the formation of auxiliary metal projections 46, 47 (FIGS. 3, 20, 21 of Goodhue) extending upwardly from the legs and corner and intermediate the flanges 40 which extend along the outer edges of the legs and corner of the angle plate. Flanges 40 in the Goodhue patent are comparable to the feet or flanges 13, 14, 15 in FIG. 1.

It would be advantageous if the manufacture of an angle plate did not require the formation of new metal projections in the inner areas of the angle plate in order to remedy the nesting problem caused by the shape of flanges which extend along the sides of the angle plate.

Accordingly, it is a principal object of the invention to provide an improved angle plate.

Another object of the invention is to provide an improved angle plate which facilitates the sliding lateral displacement and removal of the angle plate from a plurality of like angle plates stacked in registration one on top of the other.

A further object of the invention is to provide an improved angle plate which prevents nesting in the improved angle plate of a like angle plate by utilizing the flanges which extend outwardly from the peripheral side area of the legs and corner of the improve plate.

BRIEF DESCRIPTION OF THE SEVERAL VIEWS OF THE DRAWING(S)

These and other, further and more specific objects and advantages of the invention will be apparent to those skilled in the art from the following detailed description thereof, taken in conjunction with the drawings, in which.

BRIEF SUMMARY OF THE INVENTION

Figure 1:
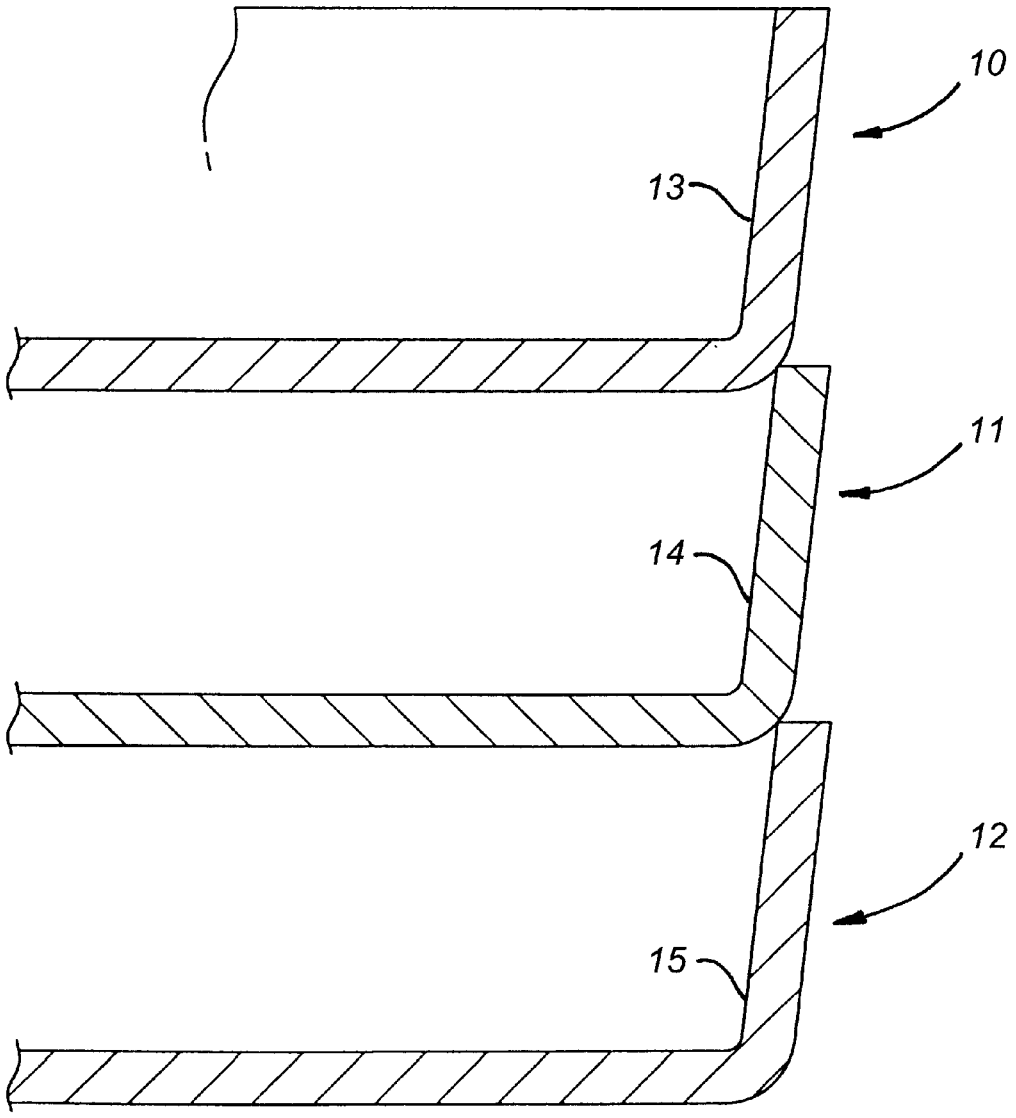
FIG. 1 is a side elevation view illustrating several angle plates in stacked, nested registration.

Briefly, in accordance with my invention, I provide an improved angle plate for joining together channel shaped flanges at an end of a duct. The improved angle plate includes a first leg having an inner side and an outer side; a second leg having an inner side and an outer side; and at least a first flange on the first leg. The first flange projects from one of a pair including the inner side and the outer side of the first leg. The first flange includes an outer edge spaced apart from the first leg. The angle plate also includes at least a second flange on the second leg. The second flange projects from one of a pair including the inner side and the outer side of the second leg. The second leg includes an outer edge spaced apart from the second leg. The angle plate also includes a corner integrally joining together the legs in angular relation. The outer edges of the first and second flanges are shaped and dimensioned to prevent nesting and to permit the sliding lateral displacement of single plates in a stack of plates.

In another embodiment of the invention, I provide an improved method for preventing angle plates from nesting when stacked. The angle plates function to join together channel shaped flanges at an end of a duct. The angle plates each include a plurality of legs; a corner integrally joining together the legs in angular relation; and, a plurality of flanges outwardly projecting from at least one of the group consisting of the legs and the corner. Each flange includes an edge. The improved method includes the step of shaping and dimensioning at least one of the flange edges to contact an angle plate stacked on the edge and prevent the stacked angle plate from nesting.

In a further embodiment of the invention, I provide an improved angle plate for joining together channel shaped flanges at an end of a duct. The improved angle plate includes a first leg having an inner side and an outer side; a second leg having an inner side and an outer side; a corner integrally joining together the legs in angular relation and having an inner side and an outer side; and, at least a first and second flange each projecting from one of the group comprising the inner side of the first leg, the inner side of the second leg, and the inner side of the corner. When horizontally oriented, the angle plate has a center of gravity spaced apart from the angle plate intermediate the first and second legs. The first and second flanges are shaped and dimensioned to support at least three points a second horizontally oriented angle flange which is slid over and contacts the first and second flanges.

In still another embodiment of the invention, I provide an angle plate for joining together channel shaped flanges at an end of a duct. The improved angle plate includes a first leg having an inner side, an outer side and a distal end; a second leg having an inner side, an outer side and a distal end; a corner integrally joining together the legs in angular relation; and, at least a first and second flange each projecting from one of the group comprising the inner side of the first leg and the inner side of the second leg. The first and second flanges are shaped and dimensioned such that the distal ends of a like angle plate being slid over the first and second flanges slidably contact the first and second flanges and are displaced away from the first and second legs, respectively.

DETAILED DESCRIPTION OF THE INVENTION

Turning now to the drawings, which depict the presently preferred embodiment of the invention for the purpose of illustrating the practice thereof and not by way of limitation of the scope of the invention, and in which like reference characters refer to corresponding elements throughout the several views, FIGS. 2 to 5 illustrate an improved angel plate 20 constructed in accordance with the invention and including generally flat panel shaped legs 22, 32 and corner 42. Legs 22 and 32 are presently preferably integrally formed with corner 42 but can be attached to corner using any desired fasteners or fastening means.

Flanges outwardly depend and project from the sides of legs 22 and 32 and corner 42. Flange 21 outwardly depends and projects from the outer side 83 of leg 22. Flange 28 outwardly depends and projects from the inner side 82 of leg 22. Flange 43 outwardly depends and projects from the outer side 85 of leg 32. Flange 44 outwardly depends and projects from the inner side 84 of leg 32. Flange 50 outwardly depends and projects from the outer side 87 of corner 42. Flange 51 outwardly depends and projects from the inner side 86 of corner 42. Flange 50 is integrally formed with flanges 21 and 43. Flange 51 is integrally formed with flanges 28 and 44. Flanges 43 and 44 are generally normal to leg 32, however, the angle between leg 32 and each flange 43, 44 can vary as desired. Flanges 21 and 28 are generally normal to leg 22, however, the angle between leg 22 and each flange 21, 28 can vary as desired. Flanges 50 and 51 are generally normal to corner 42, however, the angle between flanges 50, 51 and corner 42 can vary as desired.

Flange 21 includes linear upper edge 25. Flange 43 includes linear upper edge 37. Flange 44 includes linear upper edge 38. Flange 26 includes linear upper edge 26. The shape and dimension of flanges 21, 28, 43, 44, 50, 51 can vary as desired.

Rectangular lip 33 projects upwardly from corner 42. Leg 32 includes elongate area 34 which is slightly raised with respect to the surface 90 extending intermediate area 34 and flanges 43, 44. Leg 22 includes a similar raised area 34A.

Figure 3:
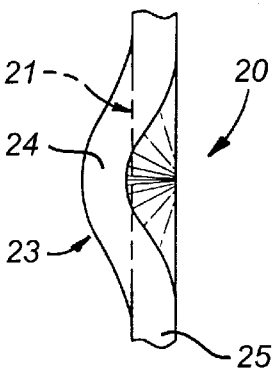
FIG. 3 is a top view of the angle plate flange of FIG. 2 further illustrating the construction thereof.
Figure 4:
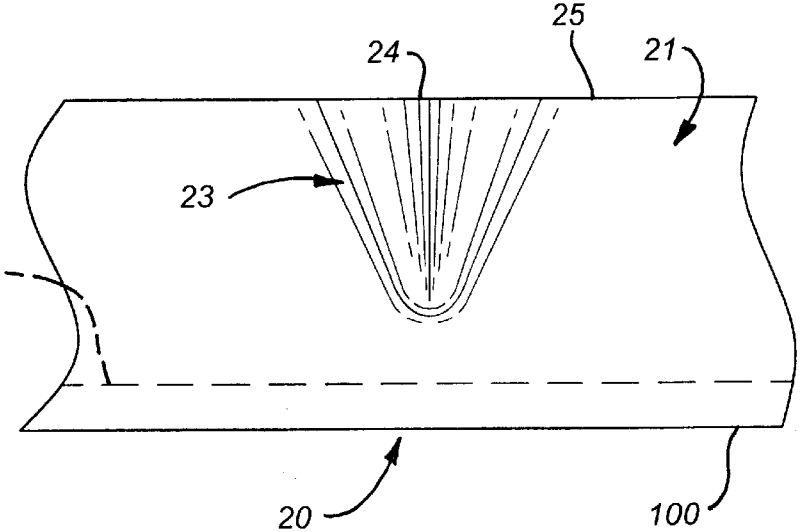
FIG. 4 is a side view of the angle plate flange of FIG. 2 further illustrating the construction thereof.
Figure 2:
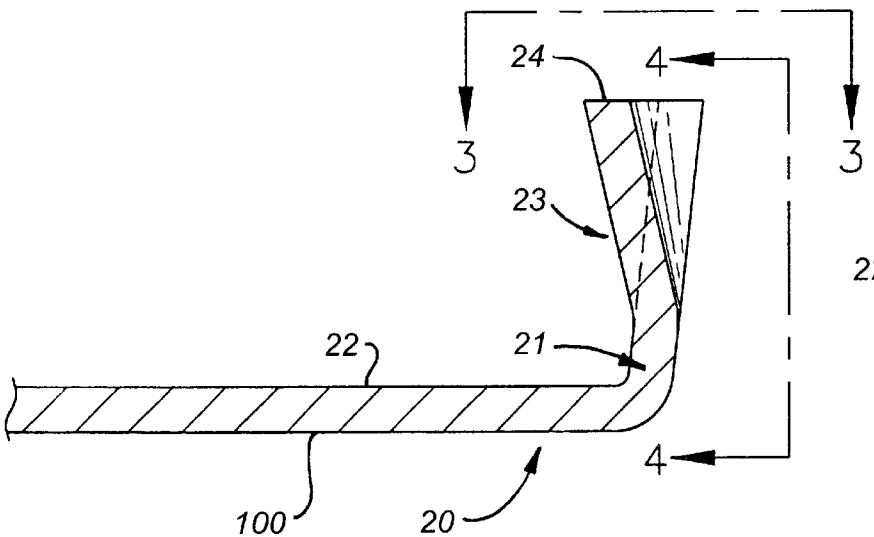
FIG. 2 is a side section view illustrating a flange of an angle plate constructed to prevent the nesting of another angle plate stacked on top of the angle plate of FIG. 2.

As is illustrated in FIGS. 2 to 4, dimple 23 is formed in flange 21 and is spaced above leg 22. Dimple 23 includes arcuate edge 24. Edge 24 extends inwardly away from edge 25 a sufficient distance to prevent an angle plate 60 from nesting in angle plate 20 when plate 60 is identical in shape and dimension to plate 20 and when plate 60 is stacked on top of and in registration with plate 20 in the manner illustrated in FIG. 5. In FIG. 2, edge 24 is generally at a height above leg 22 which is equal to the height above leg 22 of edge 25. The height of edge 24 above leg 22 can be greater than the height of edge 25 above leg 22. However, it is not presently preferred that the height of edge 24 above leg 22 be less than the height of edge 25 above leg 22. The shape and dimension of edge 24 and dimple 23 can vary as desired.

Dimple 35 formed in flange 43 has a shape and dimension equal to that of dimple 23. The upper arcuate edge 36 of dimple 35 also, like edge 24, extends inwardly from edge 37 a distance sufficient to prevent a like angle plate from nesting in plate 20 when the like angle plate is stacked on and in registration with plate 20.

Arm 39 depends on and outwardly projects from flange 44. The upper edge 92 of arm 39 is at a height above leg 32 which is equal to the height above leg 32 of edge 38. While the height of edge 38 above leg 32 can vary with respect to the height of edge 37 above leg 32, it is presently preferred that the height of edges 38 and 37 above leg 32 be equal. Similarly, the height of edge 25 and edge 26 above leg 22 can vary. It is, however, presently preferred that the height of edges 26 and 25 above leg 22 be equal. Similarly, it is presently preferred that the height that flange 50 extends above corner 42 be equal to the height that flange 51 extends above corner 42. The height of each flange 43, 44, 50, 51, 21, 28 is presently equal, although it may be desirable for the heights of certain of or all of these flanges to vary.

Dimple 39 depends outwardly from flange 44. Upper edge 92 of dimple 39 is at a height above leg 32 which is equal to the height above leg 32 of edge 38. The height of edge 92 above leg 32 can be greater than the height above leg 32 of edge 38. Dimple 39 includes sloped surface 40. Dimple 39 is spaced above leg 32, but can, if desired, contact or be integrally formed with leg 32.

Dimple 39A depends outwardly from flange 28. Upper edge 92A of dimple 39A is at a height above leg 22 which is equal to the height above leg 22 of edge 26. The height of edge 92A above leg 22 can be greater than the height above leg 22 of edge 26. Dimple 39A includes sloped surface 40A. Dimple 39A is spaced above leg 22, but can, if desired contact or be integrally formed with leg 22.

Upper edges 92 and 92A perform the same function as upper edges 24, 36 and contact and prevent the nesting of the bottom of an angle plate which is stacked on top of edges 24, 36. Consequently, when a like angle plate 60 is stacked on top of plate 20 in the manner illustrated in FIG. 5, the bottom 100 of plate 60 contacts and is supported by plate 20 at at least four points: edge 24, edge 36, edge 92, and edge 92A. It is presently preferred that bottom 100 of a plate 60 contact and be supported by plate 20 at at least three points. Dimples can, if desired be formed in flanges 28, 44, 50, and/or 51. Dimples 39 and 39A can extend inwardly from flanges 43 and 21, respectively.

Figure 5:
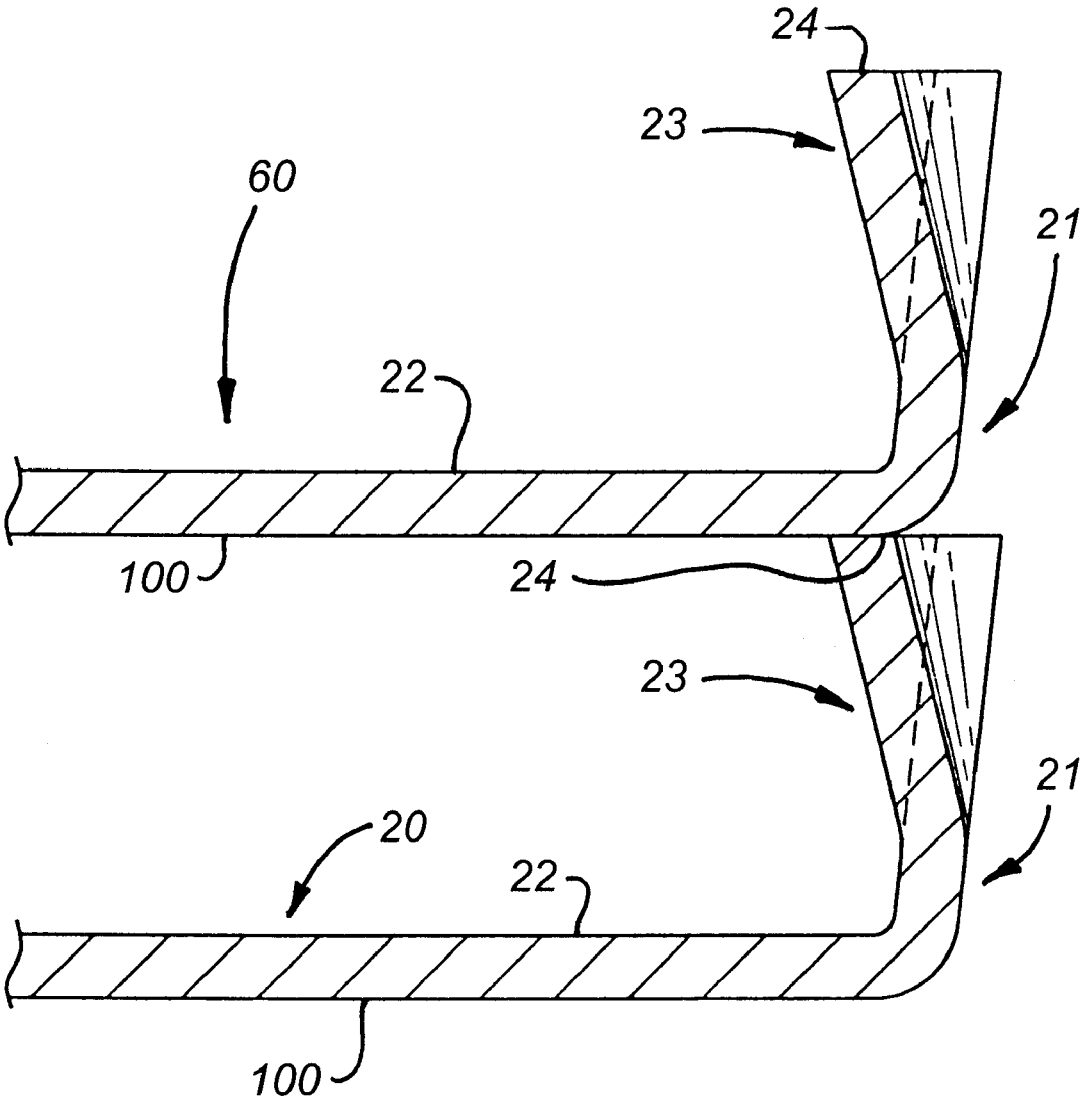
FIG. 5 is a side view illustrating a plurality of angle plates of FIG. 2 in stacked registration with each angle plate positioned for ready sliding, lateral displacement when the remaining angle plates are held in position.
Figure 6:
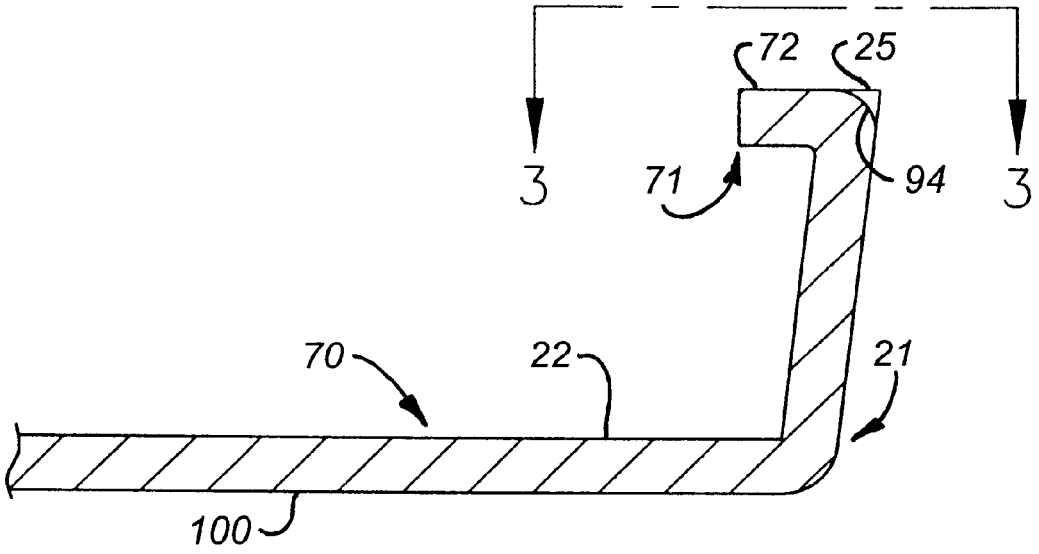
FIG. 6 is a side section view taken along section line 6—6 in FIG. 7 and illustrating an alternate flange construction in an angle plate in accordance with the principles of the invention; and, FIG. 7 is a top view of the flange of FIG. 6 further illustrating construction details thereof.
Figure 7:
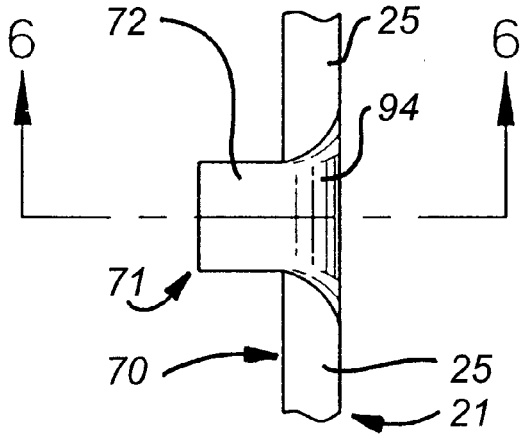

An alternate embodiment of the invention is illustrated in FIGS. 6 and 7 and comprises a dimple 71 which is formed in flange 21 in place of dimple 23. Flange 21 is part of an angle plate 70. Plate 70 is identical to plate 20 except that dimple 71 is formed in place of dimple 23. Dimple 71 includes upper edge 72. Upper edge 72 has a generally rectangular shape and is at a height above leg 22 equal to the height above leg 22 of edge 25. Upper edge 72 can be at a height above leg 22 which is greater than the height of edge 25 above leg 22. Dimple 71, like dimple 23 in FIG. 5, extends inwardly from flange 21 and is shaped and dimensioned such that when a second angle corner identical to plate 70 is stacked on and in registration with plate 70, the second angle plate does not nest in plate 70.

As would be appreciated by those of skill in the art, in FIG. 5 it is possible that (1) the second angle plate 60 stacked on plate 20 need not have a shape and dimension equal to that of plate 20, and (2) that dimples 23 could still function to prevent plate 60 from nesting in plate 20. It is normally preferred, however, for simplicity purposes, that each plate 20, 60 be of equal shape and dimension.

The apparatus of the invention comprises a preferred way of solving the problem of nesting because it utilizes the structural part of an angle plate which contributes to the problem of nesting, i.e., the invention utilizes flanges 43, 44, 50, 51, 21, and/or 28 to solve the problem. It is believed that this approach is simpler than reconfiguring legs 22, 32 and corner 42 to solve the problem.

As utilized herein, a dimple comprises an edge formed in the upper part of a flange 21, 28, 43, 44, 50, 51 to contact and help prevent the nesting of an angle plate which is stacked on the dimple in registration with the angle plate of which the dimple is a part.

Figure 4A:
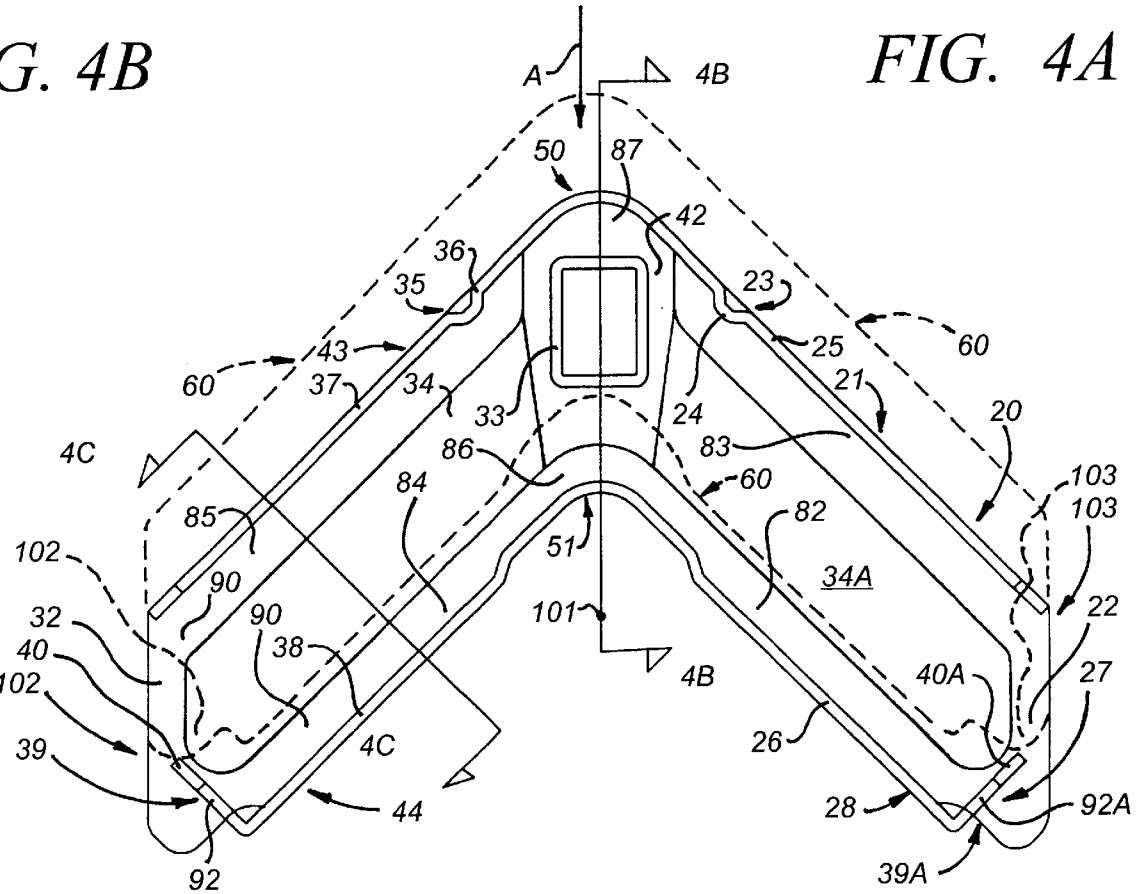
FIG. 4A is a top view further illustrating the angle plate of FIGS. 2 to 4.
Figure 4B:
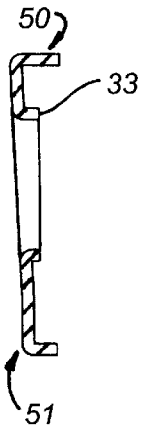
FIG. 4B is a section view taken along section line 4B—4B in FIG. 4A and further illustrating construction details of the angle corner.
Figure 4C:
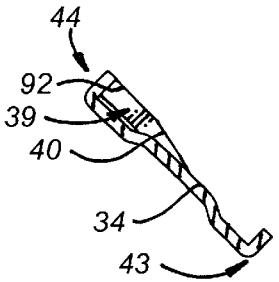
FIG. 4C is a section view taken along section line 4C—4C in FIG. 4A and further illustrating construction details of the angle plate.

Sloped surfaces 40 and 40A are important because when a second horizontally oriented angle plate 60 (which is identical in shape and dimension to plate 20 and is drawn in dashed ghost outline in FIG. 4A) is slid in the direction of arrow A over and on top of horizontally oriented plate 20 in FIG. 4A, the distal ends 102, 103 of legs 32, 22, respectively, of plate 60 slide over the edges 37 and 25 of flanges 43 and 21, respectively, and then contact sloped surfaces 40 and 40A, respectively. End 102 contacts sloped surface 40. End 103 contacts sloped surface 40A. In FIG. 4A, end 102 of plate 60 is shown as it just begins to contact surface 40. While the second plate 60 is being pushed in this manner in the direction of arrow A into registration with plate 20, surfaces 40 and 40A of plate 20 function as slides which cause ends 102 and 103 of plate 60, respectively, to slide up surfaces 40 and 40A, away from legs 32 and 22 of plate 20, and over edges 92 and 92A of plate 20, respectively. This function provided by surfaces 40 and 40A of plate 20 is important because otherwise ends 102 and 103 of plate 60 may cant downwardly, contact legs 32 and 22 of plate 20, slide along legs 32 and 22 of plate.20, and contact flange 44 or 28 of plate 20 as the case may be. If end 102 of plate 60 slides against flange 44 of plate 20 and/or end 103 of plate 60 slides against flange 28 of plate 20, the second angle plate 60 will not stack properly on top of plate 20. In FIG. 4A, plate 20 and legs 22, 32 thereof are parallel to the plane of the paper of the drawing and are parallel to the ground, i.e., FIG. 4A is a top view of horizontally oriented plate 20. When a second horizontally oriented angle plate 60 is slid over horizontally oriented plate 20, the general horizontal orientation of plates 20 and 60 is comparable to that shown in the side view of plates 20 and 60 in FIG. 5.

In FIG. 4A, plate 60 is shown sliding in the direction of arrow A over plate 20 just as distal ends 102 and 103 of plate 60 begin to contact and slide up surfaces 40 and 40A, respectively.

The center of gravity of horizontally oriented plate 20 is generally indicated by point 101 in FIG. 4A. Since the center of gravity of the horizontally oriented plate 20 (and of each like plate 60, etc.) Is located "off" the plate and intermediate legs 22 and 32, the weight of a horizontally oriented plate 60 stacked on horizontally oriented plate 20 in the manner indicated in FIG. 5 is primarily supported at points on or near the flanges 28, 44 on the inner sides of legs 22 and 32 and corner 42. Consequently, the bottom 100 of plate 60 contacts and is primarily supported at three points or areas by flange 50, by upper edge 92, and by upper edge 92A. This "three point" contact is critical in the practice of the invention. As would be appreciated by those of skill in the art, the third point of the "three point" contact need not necessarily be all or a part of flange 50, but can comprise a portion of flange 28 or 44. Such a portion of flange 28, 44 ordinarily—but not necessarily—would be near or adjacent flange 50.

Edges 24 and 36 also contact the bottom of plate 60, but serve more as safety points which will support plate 60 in the event it is skewed and not in registration with plate 20 or if the weight of a plate sliding over the top of plate 60 tends to downwardly displace the corner 42 of plate 60 toward plate 20. Having described my invention in such terms as to enable those skilled in the art to understand and practice it and having described the presently preferred embodiments thereof.

I claim:

1. A stack of angle plates each used to join together channel shaped flanges at an end of a duct, the stack including (a) a first angle plate at the bottom of the stack and including
  (i) a first leg (22) having an inner side (82), an outer side (85), a top surface (90), and a bottom (100),
  (ii) a second leg (32) having an inner side (84), an outer side (84), a top surface, and a bottom,
  (iii) at least a first flange (21)
    projecting outwardly away from said top surface and said bottom of said first leg,
    projecting from one of a pair including said inner side and said outer side of said first leg (22), and
    including an outer edge (25) spaced apart from said top surface of said first leg,
  (iv) at least a second flange (43)
    projecting outwardly away from said top surface and said bottom of said second leg,
    projecting from one of a pair including said inner side and said outer side of said second leg (32), and
    including an outer edge (37) spaced apart from said top surface of said second leg,
  (v) a corner (42) integrally joining together said legs in angular relation;

(b) a second angle plate stacked on top of and in registration with said first angle plate and having (i) a bottom, and (ii) a shape and dimension equivalent to said first angle plate, each of said first and second flanges including at least one support (23, 35, 39, 39A) formed in and extending outwardly from said flange, said support (23, 35, 39, 39A) including a surface (24, 72, 92, 92A) to (c) slidably contact and support said bottom of said second angle plate; and, (d) prevent said bottom of said second angle plate from nesting in said first angle plate;

said angle plates being shaped and dimensioned such that said second angle plate will nest in said first angle plate if said supports are removed.

2. The stack of claim 1 wherein said second angle plate includes a radius of curvature along each of said legs of said second angle plate that causes said second angle plate to nest in said first angle plate if said supports are removed.

3. The stack of claim 1 wherein said flanges of said first angle plate tilt outwardly and permit said second angle plate to nest in said first angle plate if said supports are removed.

4. A stack of angle plates each used to join together channel shaped flanges at an end of a duct, the stack including (a) a first angle plate including (i) a first leg having an inner side, an outer side, and a top surface, (ii) a second leg having an inner side, an outer side, and a top surface, (iii) a corner having an inner side, an outer side, and a top surface and integrally joining the legs in angular relation, (iv) a bottom (100), (v) at least a first flange means and a second flange means each projecting outwardly away from said bottom and from said top surface of at least one of said first leg, said second leg, and said corner, and from a different one of the group comprising said inner side of said first leg, said inner side of said second leg, and said inner side of said corner;

said first angle plate when horizontally oriented having a center of gravity spaced apart from said first angle plate and intermediate said first and second legs;

(b) a second angle plate stacked on top of and in registration with said first angle plate and having (i) a bottom, and (ii) a shape and dimension equivalent to said first angle plate;

said first and second flange means including at least three supports (39, 39A) formed in and extending outwardly from said flange, said supports (39, 39A) each including a surface (92, 92A) to slidably contact and support the bottom of said second angle plate to prevent said bottom of said stacked second angle plate from nesting in said first angle plate, said angle plates being shaped and dimensioned such that said second angle plate will nest in said first angle plate if said supports are removed.

5. The stack of claim 4 wherein said second angle plate includes a radius of curvature along each of said legs of said second angle plate that causes said second angle plate to nest in said first angle plate if said supports are removed.

6. The stack of claim 4 wherein said flanges of said first angle plate tilt outwardly and permit said second angle plate to nest in said first angle plate if said supports are removed.

7. A method for preventing a first angle plate from nesting in a second angle plate when stacked on the second angle plate, said angle plates each being used to join together channel shaped flanges at an end of a duct, said angle plates each including a plurality of legs each including a bottom (100), a corner integrally joining together the legs in angular relation, a plurality of flanges outwardly projecting from at least one of the group consisting of the legs and the corner, each flange including an edge, said method including the step of shaping and dimensioning said flanges in the second angle plate to form in each of said flanges a contact surface (24, 36) that (a) extends outwardly from said flange;

(b) slidably contacts the bottom of one of said legs of the first angle plate stacked on and in registration with the second angle plate; and, (c) prevents said one of said legs of the first angle plate from nesting in the second angle plate;

said angle plates being shaped and dimensioned such that the first angle plate will nest in said second angle plate if said contact surfaces are removed.

8. The method of claim 7 wherein said first angle plate includes a radius of curvature along each of said legs of said first angle plate that causes said first angle plate to nest in said second angle plate is said supports are removed.

9. The method of claim 7 wherein said flanges of said second angle plate tilt outwardly and permit said first angle plate to nest in said second angle plate if said supports are removed.

10. A method for stacking angle plates used to join together channel shaped flanges at an end of a duct, said method comprising the steps of (a) providing a first angle plate including (i) a first leg having an inner side, an outer side, an upper surface (90), and a distal end, (ii) a second leg having an inner side, an outer side, an upper surface, and a distal end, (iii) a corner integrally joining the legs in angular relation, (iv) a bottom (100), (v) at least a first and a second flange means each including an outer edge, and projecting from one of the group consisting of said inner side of said first leg and said inner side of said second leg;

(vi) at least one support surface (92, 92A) extending outwardly from each of said flange means and sloping upwardly away from said upper surface of said leg from which said flange means outwardly projects;

(b) providing a second angle plate having (i) a first leg having a distal end, (ii) a second leg having a distal end, and (iii) a corner integrally joining together said legs of said second angle plate in angular relation, said support surfaces of said first angle plate being shaped and dimensioned such that when said distal ends of said second angle plate are slid over said legs of said first angle plate toward said distal ends of first angle plate and contact said support surfaces, said distal ends of said second angle plate slide up said support surfaces and away from said top surfaces of said legs of said first angle plate; and, (c) sliding said second angle plate over said first angle plate such that said distal ends of said second angle plate slide up said support surfaces and away from said top surfaces of said legs of said first angle plate.

* * * * *